US008317423B2

(12) United States Patent
Marotta et al.

(10) Patent No.: US 8,317,423 B2
(45) Date of Patent: Nov. 27, 2012

(54) MASCARA FOR USE WITH A VIBRATING APPLICATOR: COMPOSITIONS AND METHODS

(75) Inventors: Paul H. Marotta, Farmingdale, NY (US); Daniela Bratescu, Northport, NY (US); Tatyana R. Tabakman, Brooklyn, NY (US); Katie Ann Frampton, West Babylon, NY (US); George J. Stepniewski, Melville, NY (US)

(73) Assignee: ELC Management LLC, New York, NY (US)

( * ) Notice: Subject to any disclaimer, the term of this patent is extended or adjusted under 35 U.S.C. 154(b) by 985 days.

(21) Appl. No.: 12/171,723

(22) Filed: Jul. 11, 2008

(65) Prior Publication Data

US 2009/0000636 A1 Jan. 1, 2009

Related U.S. Application Data

(63) Continuation-in-part of application No. 11/154,623, filed on Jun. 16, 2005, now Pat. No. 7,465,114.

(60) Provisional application No. 60/600,452, filed on Aug. 11, 2004.

(51) Int. Cl.
*A46B 11/00* (2006.01)

(52) U.S. Cl. ..... 401/126; 424/70.7

(58) Field of Classification Search ..... 401/126, 401/121, 122, 129, 130; 424/70.7
See application file for complete search history.

(56) References Cited

U.S. PATENT DOCUMENTS

| | | | | |
|---|---|---|---|---|
| 3,661,018 | A | 5/1972 | Keefer et al. | |
| 4,397,326 | A | 8/1983 | Formica | |
| 4,632,136 | A | 12/1986 | Kingsford | |
| 4,922,934 | A | 5/1990 | Gatti | |
| 5,107,870 | A | 4/1992 | Beck et al. | |
| 5,180,241 | A | 1/1993 | Gueret | |
| 5,247,218 | A | 9/1993 | Sven | |
| 5,299,354 | A | 4/1994 | Metcalf et al. | |
| 5,448,792 | A | 9/1995 | Wiedemann et al. | |
| 5,482,059 | A | 1/1996 | Miraglia | |
| 5,761,760 | A | 6/1998 | Dumler et al. | |
| 5,775,344 | A | 7/1998 | Clay | |
| 5,794,295 | A | 8/1998 | Shen | |
| 5,860,432 | A | 1/1999 | Gueret | |
| 5,937,871 | A | 8/1999 | Clay | |
| 6,009,884 | A | 1/2000 | Suh | |
| 6,214,329 | B1 * | 4/2001 | Brieva et al. | 424/70.7 |
| 6,371,131 | B1 | 4/2002 | Finocchiaro et al. | |
| 6,421,865 | B1 | 7/2002 | McDougall | |
| 6,565,276 | B1 | 5/2003 | Diaz | |
| 6,716,420 | B2 | 4/2004 | Feng et al. | |
| 6,802,097 | B2 | 10/2004 | Hafliger et al. | |
| 6,869,594 | B2 | 3/2005 | Ferrari | |
| 6,920,659 | B2 | 7/2005 | Cacka et al. | |
| 7,078,026 | B2 | 7/2006 | Ferrari et al. | |
| 7,114,506 | B2 | 10/2006 | Junkins | |
| 7,165,906 | B2 | 1/2007 | Dieudonat et al. | |
| 7,465,114 | B2 | 12/2008 | Kress et al. | |
| 7,886,393 | B2 | 2/2011 | Sorrentino | |
| 2002/0034480 | A1 | 3/2002 | Grimm et al. | |
| 2003/0089379 | A1 | 5/2003 | Gueret | |
| 2004/0134507 | A1 | 7/2004 | Gueret | |
| 2004/0240926 | A1 | 12/2004 | Gueret | |
| 2006/0032512 | A1 | 2/2006 | Kress et al. | |
| 2006/0272667 | A1 | 12/2006 | Wyatt et al. | |
| 2006/0272668 | A1 | 12/2006 | Wyatt et al. | |
| 2008/0011316 | A1 | 1/2008 | Malvar et al. | |
| 2008/0062678 | A1 | 3/2008 | Levy et al. | |
| 2008/0087296 | A1 | 4/2008 | Gueret | |
| 2008/0138138 | A1 | 6/2008 | Gueret | |
| 2011/0061186 | A1 | 3/2011 | Questiaux et al. | |

FOREIGN PATENT DOCUMENTS

| | | |
|---|---|---|
| CN | 1375273 | 10/2002 |
| DE | 8603383 | 9/1986 |
| DE | 20210482 U | 9/2002 |
| JP | 8289815 | 11/1996 |
| JP | 2004-187651 | 7/2004 |
| JP | 2005095531 | 4/2005 |
| TW | 315529 | 7/2007 |
| WO | WO2004/073936 | 9/2004 |
| WO | WO2004/073938 | 9/2004 |
| WO | WO2004/073940 | 9/2004 |
| WO | WO2004/073941 | 9/2004 |
| WO | WO2005/046508 | 5/2005 |
| WO | WO2006-020577 | 2/2006 |
| WO | WO 2007/084972 | 7/2007 |

OTHER PUBLICATIONS

PCT International Search Report; International Application No. PCT/US05/28156; Completion Date: Mar. 27, 2008; Date of Mailing: Jun. 12, 2008.

PCT Written Opinion of the International Searching Authority, or The Declaration; International Application No. PCT/US05/28156; Completion Date: Mar. 27, 2008; Mailing Date: Jun. 12, 2008.

Supplementary European Search Report; EP08022470.2; Completion Date: Mar. 11, 2009; Date of Mailing: Mar. 18, 2009.

Supplementary European Search Report; EP05784145.4; Completion Date: Mar. 10, 2009, Date of Mailing: Mar. 18, 2009.

Judy Rice; "Automated-Motion Mascara"; Packaging World; p. 98; Sep. 2006.

PCT International Search Report; International Application No. PCT/US2009/045210; Completion Date: Jan. 13, 2010; Date of Mailing: Jan. 14, 2010. (Related U.S. Appl. No. 12/128,170).

PCT Written Opinion of the International Searching Authority, or The Declaration; International Application No. PCT/US2009/045210; Completion Date: Jan. 13, 2010; Mailing Date: Jan. 14, 2010. (Related U.S. Appl. No. 12/128,170).

PCT International Search Report; International Application No. PCT/US2009/049892); Completion Date: Feb. 18, 2010; Date of Mailing: Feb. 19, 2010. (Related U.S. Appl. No. 12/171,723).

PCT Written Opinion of the International Searching Authority, or The Declaration; International Application No. PCT/US2009/049892; Completion Date. Feb. 19, 2010; Mailing Date: Feb. 18, 2010. Related U.S. Appl. No. 12/171,723).

* cited by examiner

*Primary Examiner* — David Walczak
(74) *Attorney, Agent, or Firm* — Peter Giancana

(57) ABSTRACT

Compositions for use with a mascara applicator with vibrating applicator head. The frequency, amplitude and geometry of the vibrating head are sufficient to significantly alter the rheological properties of thixotropic and anti-thixotropic mascara compositions, including an effect that persists after the vibration has stopped. The mascara may be manipulated for improved results, greater flexibility in formulation, benefits in manufacture, as well as other benefits.

11 Claims, 6 Drawing Sheets

MASCARA FOR USE WITH A VIBRATING APPLICATOR: COMPOSITIONS AND METHODS

The present application is a CIP of Ser. No. 11/154,623 filed Jun. 16, 2005, now U.S. Pat. No. 7,465,114 issued Dec. 18, 2008, which claims priority under 35 U.S.C. 119e of U.S. provisional application 60/600,452 filed Aug. 11, 2004.

The present application incorporates by reference, in its entirety, the contents of US20060032512 (U.S. Ser. No. 11/154,623; Kress et al.) and U.S. Ser. No. 60/600,452 (Kress).

FIELD OF THE INVENTION

The present invention is in the field of cosmetics and particularly pertains to mascara compositions specifically designed or identified for use with a vibrating applicator.

BACKGROUND

Mascara products are very popular. Today, the best selling mascara products have department store sales between one and five million dollars per year in the United States alone. Because of this, significant resources are devoted to the development of innovative mascara products. Innovative mascara products are those that introduce new features to the consumer or that improve upon exiting mascaras by making them perform better or by making them less expensive. Innovation in mascara products may occur in the composition or in the applicator used to apply the composition. Being innovative in the field of mascara products can be a challenge because mascara compositions are one of the most difficult cosmetics to formulate, package and apply. In part, this is owing to the physical and rheological nature of the product. Mascara is a heavy, viscous, sticky and often messy product. It does not flow easily in manufacture, filling or application, while drying out quickly at ambient conditions. It may contain volatile components that make safety in manufacture an issue. Mascara is also difficult because of the target area of application. The eyelashes offer a very small application area, while being soft, flexible, delicate and in close proximity to very sensitive eye tissue. Being flexible, the eyelashes yield easily under the pressure of a mascara applicator which makes transfer of the product onto the lashes difficult. The act of transferring a rheologically difficult product to a small, delicate target, and in so doing, achieve specific visual effects, is the challenging task of mascara application. Furthermore, mascara is unlike most cosmetic products because more than most cosmetics, the success of a mascara product depends on using the product with the right applicator. The overall consumer experience depends on both the product and on the applicator used to apply it. A well executed mascara formulation may prove to be a failure in the marketplace if not sold with the right applicator to apply and work the mascara onto the lashes, to achieve the desired effect. Taken the other way, not every mascara composition is right for every kind of mascara applicator. Therefore, a mascara product that is sold with an otherwise commercially popular applicator, may not be well received by the consuming public, if the mascara composition does not complement the applicator function. For this reason, early in development, mascara formulators should and do consider what type of applicator will best complement their composition or what type of composition will benefit the most from a particular applicator. The present application is concerned with the question: given a vibrating applicator, which types of mascaras give the best performance and most benefits?

Prior to U.S. Ser. No. 11/154,623 (hereinafter, the "Kress application"), there may have been very little disclosure in the prior art concerning which type of mascara compositions work better with which types of applicator. By "work better" we mean that one or more art-recognized properties of mascara application is improved by choosing a particular kind of mascara for use with a particular kind of applicator, compared to the same mascara with some other applicator or a rheologically different mascara with the same applicator. Specifically, applicants were unaware of any disclosure concerning which types of mascara compositions would benefit from use with a vibrating applicator. For the vast majority of mascara products on the market, no mechanism is provided to alter the rheological and application properties of the mascara at the time of application.

U.S. Pat. No. 5,180,241 describes a mascara container and conventional mascara brush wherein the container includes a helical spring on the inside of the container, through which the brush must pass on its way out of the container. The product on the brush is said to have its thixotropy broken by the action of the loaded bristles flexing and straightening as they squeeze through the turns of the spring. The reference does not quantify in any way to what degree the viscosity is affected nor how long the effect lasts. Disadvantages of this system include the fact that the mascara is only sheared for a moment while the brush is passing through the spring. There is no mechanism for longer, continuous shearing for an extended period of time, several seconds or minutes. There is no shearing after the brush is removed from the container, for example, while the mascara is being applied to the lashes. During this time, the viscosity, to the extent that it may have been reduced, is building back to its original value, so that the full, if any, advantage is not even realized. If a user attempts to increase the amount of shearing by repeatedly pumping the applicator through the spring, this will have the detrimental effect of incorporating air into the product and drying it out. This would actually produce a result opposite to that intended, causing the product to thicken and flow less well. Also, in this reference there is no mention of mascaras that are capable of anti-thixotropic behavior (or thickening when sheared) and no suggestion of how this system may affect future mascara formulations. This is unlike the present invention wherein the viscosity is substantially, measurably altered by shearing, the duration of which is controllable by the user and which duration may be several seconds or minutes. Pumping the applicator is not necessary to cause shearing and anti-thixotropic mascaras can benefit from the present invention as well as thixotropic. Also, the present invention opens the way for changes in the way mascaras are conventionally formulated.

In U.S. Pat. No. 5,775,344, the mascara product is heated just prior to and/or during application. Generally, heat is supplied by a heating element powered by a battery. The heating element may be in the container that holds the mascara or in the brush that is dipped into the mascara. The '344 patent discloses cosmetic product devices that heat the entire contents of a reservoir prior to an application, each time this device is used. But it should be appreciated that not all mascaras can be temperature cycled without damaging the product. For mascaras that will be changed structurally or chemically by the application of too much heat or from being too often heated, these devices are wholly unsuitable. This is unlike the present invention, wherein the product remaining in the reservoir is not heated and remains in good condition for future use. Another disadvantage of these devices is the need for thermal insulation to keep the heat inside the reservoir. The insulation makes these devices more complex and costly than the present invention, wherein the reservoir is neither heated nor insulated.

Since the Kress application, it is clear that a vibrating mascara applicator having a vibrational frequency from about 10 to about 1000 cycles per second, can have a substantial persisting rheological effect on a mascara composition (as the term "persisting rheological effect" is defined in the Kress application). Thus, since the Kress application, a mascara composition's response to vibration (i.e. its rheological profile) has taken on a much greater significance to the expert mascara formulator.

A thorough discussion of the measurement of rheological profile and the response of mascara to a vibrating applicator, can be found in the Kress application. A thorough discussion of mascara brush characteristics and mascara brush performance can be found in the Kress application. Also, a thorough discussion of prior art motion mascara brushes and other electric brush devices can be found in the Kress application.

Mascara Compositions: Typical Components

Turning now, to mascara compositions, conventional mascara formulations include oil-in-water emulsion mascaras which may typically have an oil phase to water ratio of 1:7 to 1:3. These mascaras offer the benefits of good stability, wet application and easy removal with water, they are relatively inexpensive to make, a wide array of polymers may be used in them and they are compatible with most plastic packaging. On the down side, oil-in-water mascaras do not stand up well to exposure of water and humidity. Oil-in-water mascaras are typically comprised of emulsifiers, polymers, waxes, fillers, pigments and preservatives. Some polymers behave as film formers and improve the wear of the mascara. Some polymers affect the dry-time, rheology (i.e. viscosity), flexibility, flake-resistance and water-proofness of the mascara. Waxes also have a dramatic impact on the rheological properties of the mascara and will generally be chosen for their melt point characteristics and their viscosity. Inert fillers are sometimes used to control the viscosity of the formula and the volume and length of the lashes that may be achieved. Amongst pigments, black iron oxide is foremost in mascara formulation, while non-iron oxide pigments for achieving vibrant colors has also become important recently. Preservatives are virtually always required in saleable mascara products.

There are also water-in-oil mascaras whose principle benefit is water resistance and long wearability. These mascaras may typically have an oil phase to water ratio of 1:2 to 9:1. Various draw-backs of water-in-oil mascaras may include: difficulty in removing the product from the lashes, a long dry-time, a high degree of weight loss from the product reservoir, generally less compatibility with packaging materials than oil-in-water mascaras and a relatively low flash point. Water-in-oil mascaras are typically comprised of emulsifiers, waxes, solvents, polymers and pigments. Volatile solvents facilitate drying of the mascara. Polymers play a similar role in water-in-oil mascaras as in oil-in-water discussed above, although in the former, an oil miscible film forming polymer is recommended. The same classes of pigments may be used in water-in-oil mascaras, as in oil-in-water. Here though, a hydrophobically treated pigment may provide improved stability and compatibility.

The more common mascara formulations comprise one or more waxes, which provide all or the most significant portion of a mascara's structure, although polymer's may also act as structuring agents. This is true whether the mascara is oil-in-water or water-in-oil. In recent years, gel mascaras or gel-based mascaras have gained popularity. Gel mascaras may also be oil-in-water or water-in-oil emulsions, or non-emulsions, and in general, one or more gelling agents are added to a water or oil phase. The gel network is able to provide significant structure to the mascara, so that a reduced amount of wax, sometimes no wax, is needed. The gel network is so efficient at creating structure, that gel-based mascaras and wax-based mascara typically have comparable order of magnitude viscosities. A non-exhaustive list of gellants which may be used as structuring agents in the production of gel-based mascaras includes:

Water phase—sodium polymethacrylate, sodium polyacrylate, polyacrylate, polyacrylate copolymers, ammonium acrylodimethyl taurate/VP copolymer, ammonium acrylodimethyl taurate/beheneth 25 methacrylate crosspolymer, acrylates/C10-30 akyl acrylates crosspolymer, carbomer, polyquaternium, carrageenan;

Oil phase—VP/eicosene copolymers, polyisobutene, polypropylene, polyethylene, polyurethane, ethyl cellulose, bentonite, dextrin palmitate, stearoyl, inulin, dibutyl lauroyl glutamide, dibutyl ethylhexanoyl glutamide, rosinates and resoinate derivatives, polyamides and derivatives;

Gums—xanthan gum, cellulose, carboxymethylcellulose, hydroxyethylcellulose, agar, starch, tapioca starch, clays, (kaolin, bentonite), PVP.

Mascara Compositions: Characteristics

There is an established vocabulary for discussing the performance characteristics of mascara. Each of these characteristics can be evaluated and assigned a number on a random scale, from 0 to 10, say, for purposes of comparison during formulation. "Clumping", as a result of mascara application, is the aggregation of several lashes into a thick, rough-edged shaft. Clumping reduces individual lash definition and is generally not desirable. "Curl" is the degree to which a mascara causes upward arching of the lashes relative to the untreated lashes. Curl is often desirable. "Flaking" refers to pieces of mascara coming off the lashes after defined hours of wear. The better quality mascaras do not flake. "Fullness" depends on the volume of the lashes and the space the between them, where "sparse" (or less full) means there are relatively fewer lashes and relatively larger separation between the lashes and "dense" (or more full) means the lashes are tightly packed with little measurable space between adjacent lashes. "Length" is the dimension of the lash from the free tip to its point of insertion in the skin. Increasing length is frequently a goal of mascara application. "Separation" is the non-aggregation of lashes so that each individual lash is well defined. Good separation is one of the desired effects of mascara application. "Smudging" is the propensity for mascara to smear after defined hours of wear, when contacting the skin or other surface. Smearing is facilitated by the mascara mixing with moisture and/or oil from the skin or environment. "Spiking" is the tendency for the tips of individual lashes to fuse, creating a triangular shaped cluster, usually undesirable. "Thickness" is the diameter of an individual lash, which may be altered in appearance by the application of mascara. Increasing thickness is usually a goal of mascara application. "Wear" is the visual impact of a mascara on the lashes after defined hours as compared to immediately after application. "Overall look" is one overall score that factors in all the above definitions. It is a subjective judgment comparing treated and untreated lashes or comparing the aesthetic appeal of one mascara to another. The ideal mascara will possess all of the desirable properties while avoiding the undesirable.

While all of the mascara characteristics mentioned above are useful and may be important to the mascara formulator, fullness, clumping and separation are usually strongly correlated with each other. While clumping is an undesirable property of mascara, it has historically been difficult to achieve fullness without some amount of clumping. That's is to say, fullness and clumping have a direct correlation. However, clumping is contrary to lash separation, so fullness and lash separation have usually had an inverse relationship. Thus, the art of conventional mascara formulation is a balancing act between separation and fullness, between too much of one and not enough of the other. One of the advantages of the present invention is that the inverse relationship between fullness and separation is corrected, so that both may be increased simultaneously.

Often, the formulator is interested in achieving thicker, fuller, well separated lashes. Characteristics like clumping and spiking tend to work against this, and a developer can improve one or more characteristics only at the expense of others. For example, to increase the fullness of a particular mascara, conventional wisdom suggests adding more structure to the composition. Conventionally, this means adding solids and semi-solids, such as waxes and fillers, to the mascara composition. However, one disadvantage of doing this is that it tends to increase the viscosity and clumping of the composition and decrease the user's ability to separate the lashes. A high level of solids and semi-solids can also create a negative sensorial effect because the high viscosity makes the mascara difficult to spread over the lashes. The result can be tugging on the lashes, discomfort associated therewith and a poor application. Furthermore, in recent years, structure has sometimes been added to mascara compositions by the use of one or more gellants. Gellants are able to provide structure that enhances fullness. However, the response of gel-type mascaras to a vibrating applicator is not likely to be the same as the response of wax-based mascaras. Certainly, this difference in behavior has not been contemplated or exploited in the prior art.

Virtually all mascaras can, if shearing means are provided, exhibit some degree of thinning or thickening behavior. With a non-vibrating brush, a user cannot significantly shear a mascara to cause it to exhibit its thinning or thickening behavior. Even if some alteration of the product's viscosity did occur as a result of a conventional applicator shearing the product in the container, the amount would be insignificant as compared to an applicator according to the Kress application, and no significant advantage would accrue to the user. To the best of the applicant's knowledge, the prior art does not identify or suggest which types of mascara compositions are best suited for use with a vibrating brush.

Throughout the specification, "static" or "at rest" mascara refers to mascara not subject to applied shear, so that the mascara is at rest, internally. For example, after a mascara has been applied to the lashes, it is static or at rest. While the mascara is being applied with a vibrating applicator, the mascara is undergoing shear, and is not "static" or "at rest".

In terms of a vibrating applicator, it would sometimes be ideal to increase the structure of a mascara when the mascara is at rest (thus, increasing fullness), while minimizing the increase in viscosity of the mascara, when the mascara is undergoing shear. At other times, it may be ideal to increase structure when the mascara is undergoing shear (thus, increasing fullness) and retaining that structure in the mascara after the mascara is at rest.

Also, with the introduction of the commercially feasible vibrating mascara brush, it is now desirable to identify which types of mascara display an unusually large decrease in viscosity when undergoing shear, but which rebuild structure when shear is removed. Such mascara are expected to score relatively highly on separation and fullness, with decreased clumping.

Another phenomenon that has come to light since the Kress application, is the effect of a vibrating applicator on some ingredients in a mascara formulation. A case in point is microspheres or spheroidal particles, which may conventionally be added to reduce viscosity and aid spreading a mascara evenly over a target surface. With a vibrating brush, a problem of the spheroids sliding over and not adhering to the lashes has been observed. In one embodiment of the present invention, this problem is addressed.

In recent years, the idea of creating an alignment of certain filler materials or particles, in a direction parallel to the length of the lashes, has been suggested as a means to achieve a superior mascara application. In US2008/0138138, it was noted that a vibrating applicator may "obtain a better orientation of said fibers". The reference only address the response of fibers, and not other types of fillers or particles, such as mica and spheres.

OBJECTIVES

A main object of the present invention is to provide a mascara composition for use with a vibrating applicator, that displays improved fullness and separation and reduced clumping, compared to other compositions known in the art.

Another object of the invention is to provide mascara compositions for use with a vibrating applicator, wherein fullness and separation display a direct correlation.

Another object of the invention is to increase the structure of a mascara when the mascara is "static", while minimizing the increase in viscosity of the mascara when the mascara is undergoing shear (i.e. when it is being applied).

Another object is to provide mascara compositions that are suitable for use with a vibrating brush even though the compositions are unsuitable for use with a non-vibrating brush due to the compositions' rheological properties.

Another object of the present invention is to improve mascara application by providing a method of formulating mascara compositions that are suitable for use with a vibrating applicator.

Another object of the invention is to address a problem posed by the presence of spheroidal particles in mascara applied with a vibrating applicator.

The foregoing objects and other benefits may be realized by mascara compositions whose viscosity is predictably altered at the time of use by a vibrating applicator. Other objects of the invention and the advantages of it will be clear from reading the description to follow.

SUMMARY

Figure 1A:
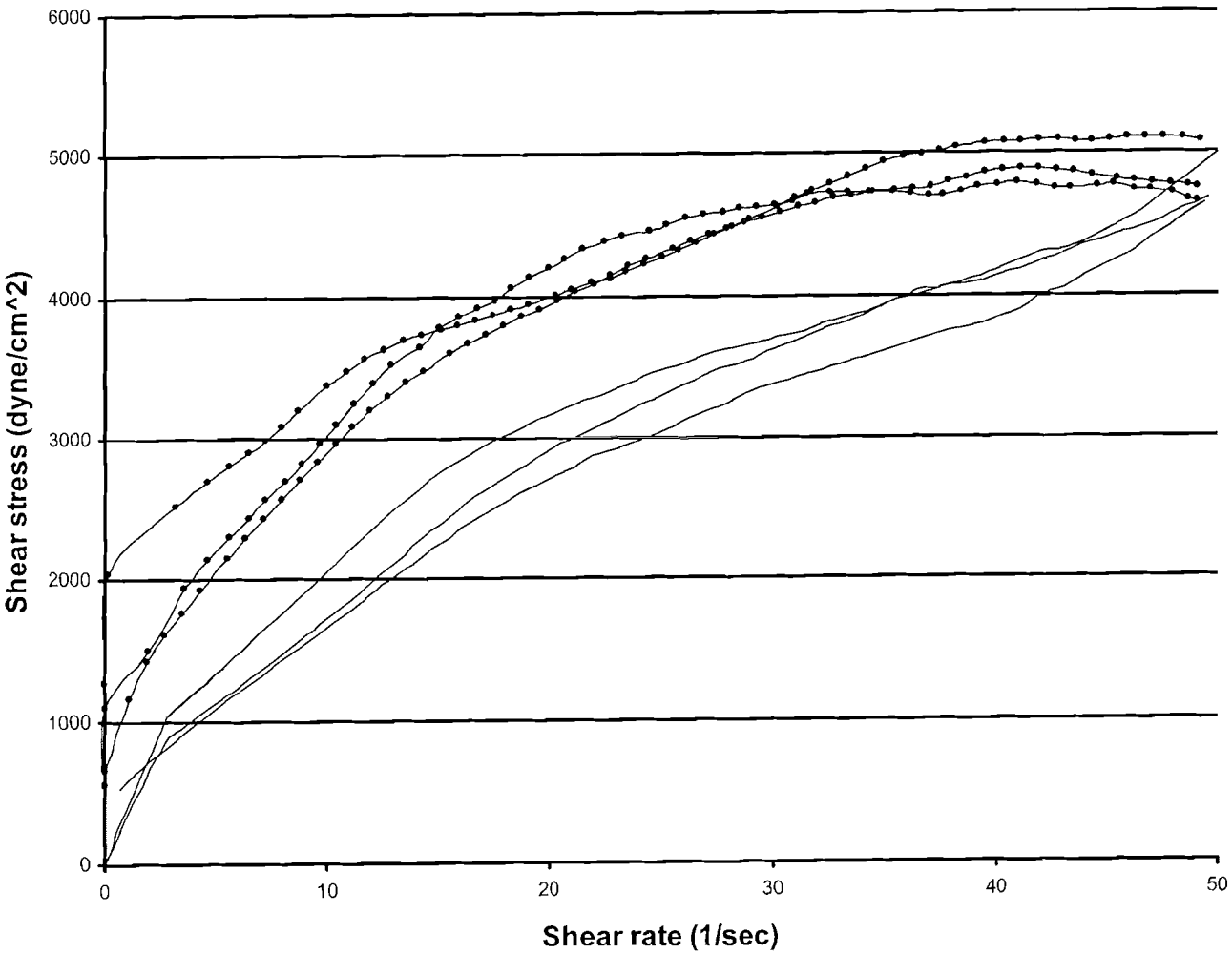
FIGS. 1*a* and 1*b* are hysteresis loops generated in standard rhoemetric tests of a thixotropic mascara.

The mascara compositions described herein, are designed to respond in a predictable and useful way to the an applied vibration, thus allowing the mascara to be manipulated at the time of use, for improved results. Some of the methods described herein require a knowledge of the thixotropic or anti-thixotropic response of a mascara, unlike anything described in the prior art of mascara formulation. When formulating or identifying a mascara for use with a vibrating applicator, the structure and behavior of mascara must be understood, not only when the mascara is "at rest", but after the mascara has undergone substantial shearing.

The use of preferred thixotropic or anti-thixotropic compositions in combination with a vibrating applicator leads to benefits in the field of mascara application and performance. In particular, substantial improvements in fullness, separation and clumping are achieved. The ability to manage the level of structure of the composition "at rest", while also controlling the viscosity of the composition at the time of application, significantly enhances the types of formulations that may be offered to consumers and offers benefits in manufacture and cost of production.

DETAILED DESCRIPTION

Throughout this specification, the terms "comprise," "comprises," "comprising" and the like shall consistently mean that a collection of objects is not limited to those objects specifically recited.

Throughout this specification, the terms "vibration" and "oscillation" are used interchangeably and refer to repetitive movement characterized by an equilibrium position, a maximum displacement from equilibrium and a frequency. In this definition, a vibrating object may or may not pass through the equilibrium position, but one or more components of the motion of the object tend toward the equilibrium position after the maximum displacement has been reached. In general, a mascara applicator that rotates in one direction, about the long axis of the applicator rod, without a side to side movement of the rod, is not included in this definition. Such a rotating applicator, and the energy that it may impart to a composition is not vibrational energy. The difference is important, because the response of a given composition to vibrational and non-vibrational energy, will be qualitatively different.

Compositions and methods of the present invention are not limited by any one particular type vibratory or oscillatory motion of the applicator. One type of oscillatory motion is a simple back and forth or simple side to side motion, perpendicular to the axis of the rod. More complex side to side motions are possible and may be useful for different types of mascara compositions. Motions characterized by saying that the tip of the applicator head traces out a closed path, like a circle, ellipse or figure eight are examples of more complex side to side motions that are encompassed by the present invention.

The present invention concerns a mascara applicator that has a vibrating or oscillating applicator head. This broad concept is applicable to an unlimited range of mascara applicator types, as well as to cosmetic and personal care applicators and grooming tools in general. For simplicity, the starting point for this discussion is a typical bristle brush applicator, known in the art. However, in principle, with the benefit of this disclosure, a person of ordinary skill in the art can apply the teachings of this disclosure to virtually any type of mascara applicator. Therefore, the applicator head is not limited to being a bristle head and may be any other type of mascara applicator head.

Effect of a Vibrating Applicator on Mascara

In this section, it will be shown that a vibrating brush according to the present invention can have a persisting effect on the rheology of a mascara. Generally, fluid flow properties, like viscosity, depend on three factors: temperature, rate of applied shear, and time of applied shear. Heating a mascara to alter its flow properties, as in the '344 patent, is fundamentally different from the present invention which relies on shearing the product and wherein the temperature remains substantially constant. Not only do heating and shearing alter the viscosity of a given material by different molecular mechanisms, but the behaviors of the material after the heating or shearing is removed are different from one another, so the two methods of altering the viscosity are not the same. Of particular interest in this application is the behavior of mascara when sheared with a vibrating brush for a defined period and in the minutes after the shearing is abruptly removed. Standard definitions of rheological terms are somewhat application dependent, but those found in the following reference may be useful to the reader: "Guide To Rheological Nomenclature: Measurements In Ceramic Particulate Systems;" National Institutes of Standards and Technology Special Publication 946, January 2001; herein, incorporated by reference.

FIGS. 1*a* and *b* and 2*a* and *b* are graphs of measurements made during two standard rheometric tests for each of two mascara compositions. These are variable rate shear tests that characterize the behavior of a material over a range of applied shear. The rate of applied shear is shown on the horizontal axis and the stress induced in the test material is shown on the vertical axis. Starting from zero, shear is increased over a defined range, either 0 to 50 or 0 to 1000 $sec^{-1}$, in these tests. As the shear increases, so too does the stress in the sample, recorded in the graph as dynes per centimeter square. When the upper limit shear rate has been reached, the rate of shear is decreased in a controlled manner back to zero and the stress measured along the way. The entire test may take as little as two minutes. In the graphs, dotted curves (or "up curves") represent the induced stress as shear is being ramped up and un-dotted curves (or "down curves") track the stress as the shear is being ramped down. Each graph shows three test samples: a control (labeled "C"); a sample that had been pre-sheared for three minutes with a vibrating brush according to the present invention, (labeled 3); a sample that had been pre-sheared for ten minutes with a vibrating brush according to the present invention, (labeled 10). The pre-sheared samples were tested within two or five minutes after the pre-shearing step.

These measurements were conducted at ambient conditions using a standard parallel steel plate geometry, the plate having a diameter of 2.0 cm and a 200 micron gap. The test duration was 2.0 minutes, one minute ramping the shear up and one minute ramping the shear down. On graphs 7*a* and 8*a*, the initial shear was 0 $sec^{-1}$ and the maximum was 50 $sec^{-1}$ (the low shear test). On graphs 1*b* and 2*b*, the initial shear was 0 $sec^{1}$ and the maximum was 1000 $sec^{-1}$ (the high shear test). The ramp mode was linear and continuous. The vibrating applicator used to pre-shear the samples was a twisted wire core bristle brush applicator, having a vibrational frequency of 50 cycles per second, constructed according to the present invention.

In the graphs, the fact that the down curve does not exactly retrace the up curve is indicative of so-called "thixotropic" or "anti-thixotropic" behavior, the area between the curves providing a measurement of the degree of either. In such a plot, ranges of shear where the up curve lies above the down curve indicate thixotropic behavior while ranges of shear where the down curve lies above the up curve indicate anti-thixotropic behavior. The mascara of FIGS. 1*a* and 1*b* behaves thixotropically over the whole test range in both tests of all three samples. The mascara of FIG. 2*a* exhibits anti-thixotropic behavior above a shear rate of about 20 to 25 $sec^{-1}$. This anti-thixotropic behavior continues on to about 600 $sec^{-1}$ in graph 2*b*. Outside of either of these regions the mascara is behaving thixotropically.

It is crucial to realize that the test samples that were pre-sheared with a vibrating brush (those labeled 3 and 10) performed differently than the control sample (labeled C). This is true even though the pre-sheared samples were not measured until two to five minutes after being pre-sheared. This means that the vibrating brush has a persisting effect on the rheology (i.e. viscosity) of the mascara composition. That the vibrating brush is effective to alter the rheology of mascara can be seen from Tables 1 and 2. The average applied stress is the stress required to deform (shear) the mascara, being averaged over the shear rate range 100 to 900 $sec^{-1}$. This value was derived from the data of FIGS. 1*b* and 2*b* for the control, and the three and ten minute pre-sheared samples. Percent changes verses the controls are shown.

TABLE 1

Figure 1B:
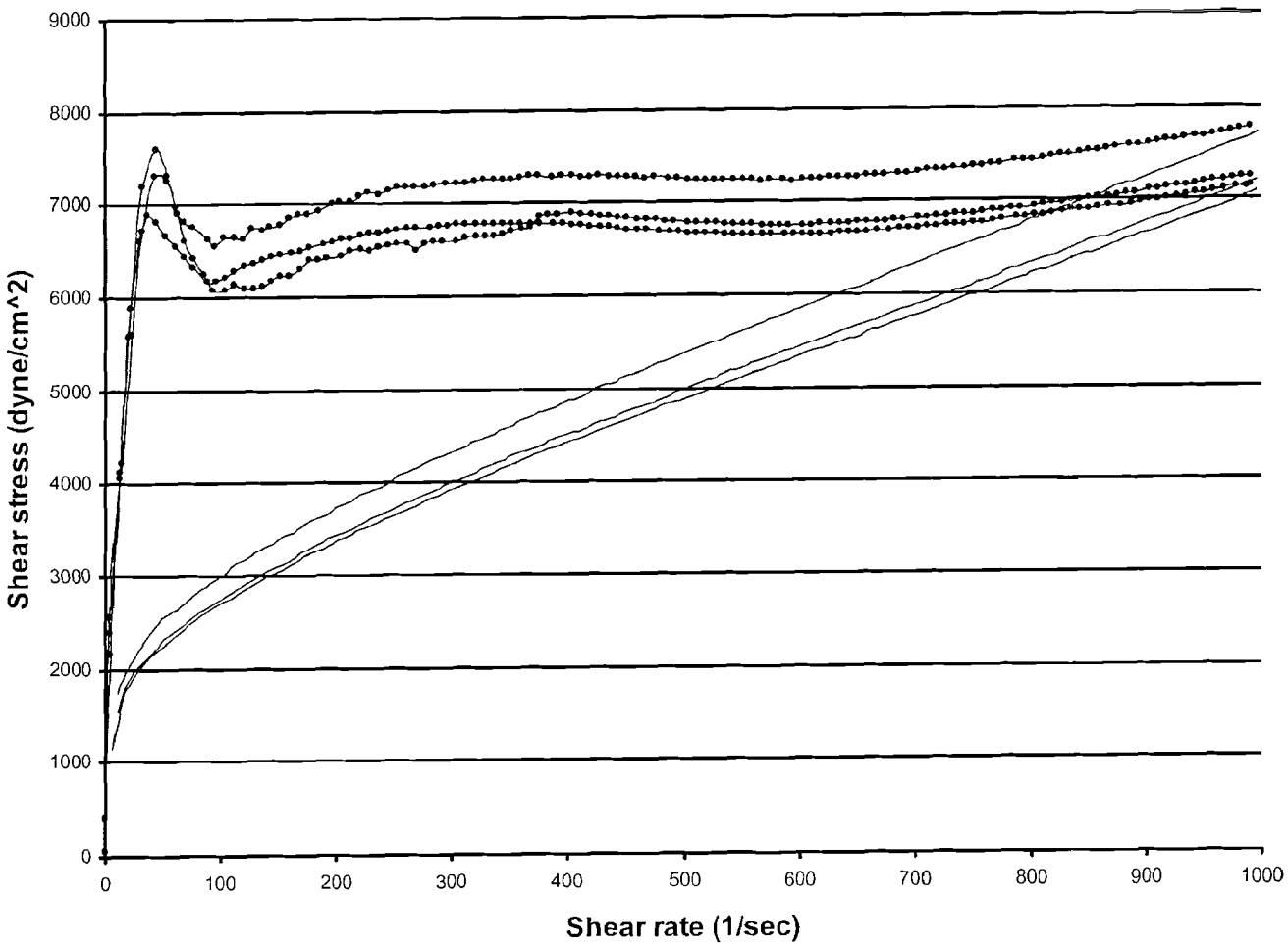
Figure 2A:
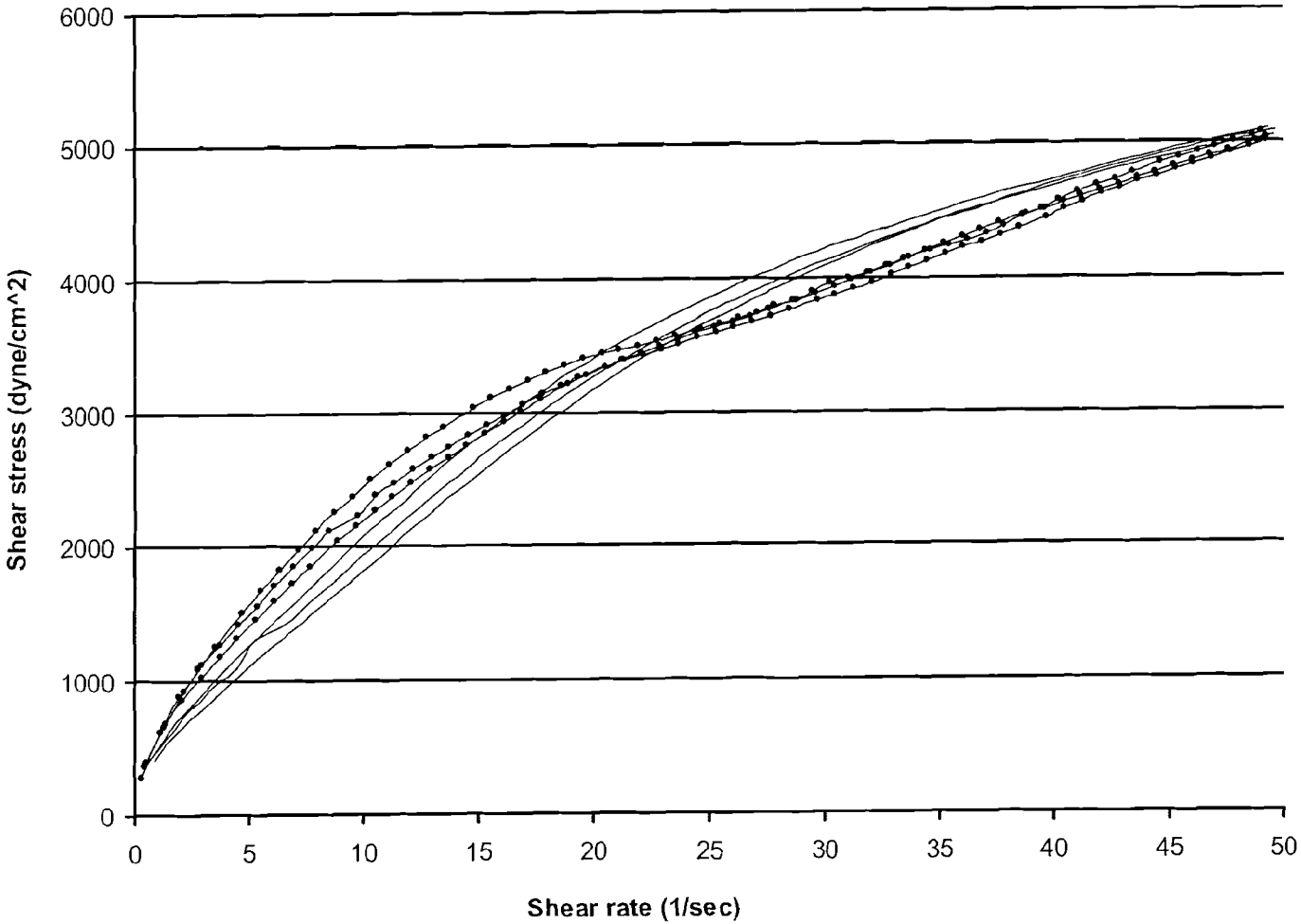
FIGS. 2*a* and 2*b* are hysteresis loops of an anti-thixotropic mascara.

| Data from test sample of FIG. 1b | % change of average applied stress vs. control |
|---|---|
| 3 min vibration | −7.30% |
| 10 min vibration | −6.71% |

TABLE 2

Figure 2B:
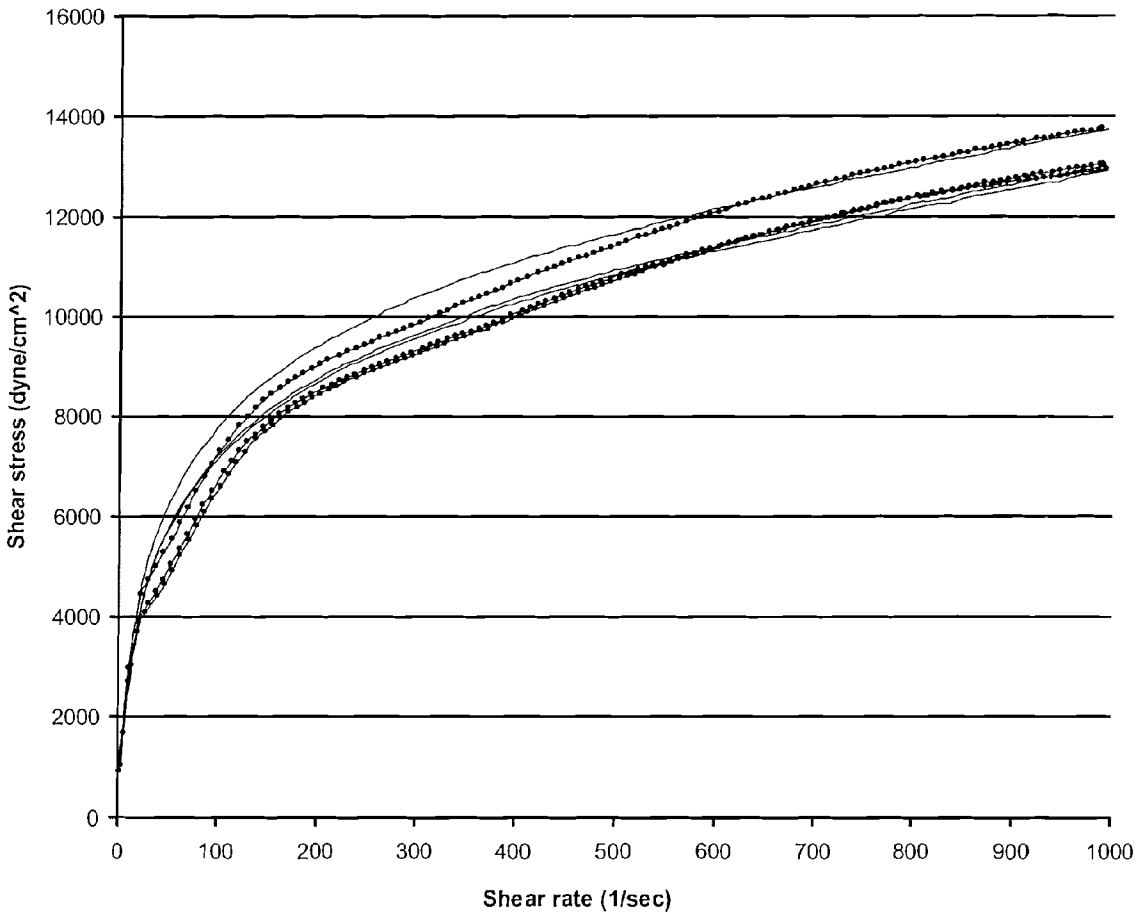

| Data from test sample of FIG. 2b | % change of average applied stress vs. control |
|---|---|
| 3 min vibration | 0.70% |
| 10 min vibration | 6.49% |

Table 1, corresponding to FIG. 1*b*, shows that, compared to the control, less stress was required to deform (shear) the pre-sheared mascara. In other words, the vibrating brush lowered the viscosity of the mascara and this lowered viscosity persisted for at least two to five minutes after the brush was removed. Table 2, corresponding to FIG. 2*b* shows that on average, compared to the control, more stress was required to deform (shear) the pre-sheared mascara. In other words, the vibrating brush increased the viscosity of the mascara and this increased viscosity persisted for at least two to five minutes after the brush was removed.

Tables 3 and 4 make this point again. The data in these tables is again taken from the tests represented in FIGS. 1 and 2, respectively. The tables list the viscosity of the mascara at selected rates of shear, during the test, as the shear was being ramped up and as the shear was being ramped down. In Table 3, we see the control go from a viscosity of about 64 poise at 100 $sec^{-1}$ shear rate, down to about 8 poise at 900 $sec^{-1}$ shear rate, then back up to about 29 poise at 100 $sec^{-1}$. The mascara has been thinned considerably by the test. The same pattern can be seen for the three and ten minute samples, however, and very importantly, the whole range of viscosity has shifted down as a result of the pre-shearing by the vibrating brush. It should be remembered that the pre-sheared samples sat for two to five minutes prior to running the rheology test, during which time the viscosity is re-building although clearly, the viscosity remains significantly below the control value by the start of the test. In other words, the thinning effect of the vibrating brush persists for more than two to five minutes.

TABLE 3

| | Viscosity (poise) @ 100 1/sec | Viscosity (poise) @ 400 1/sec | Viscosity (poise) @ 900 1/sec |
|---|---|---|---|
| Viscosity reading (during ramp up) | | | |
| control | 64.24 | 18.09 | 8.424 |
| 3 min vibration | 59.24 | 16.74 | 7.736 |
| 10 min vibration | 58.27 | 17.03 | 7.853 |
| Viscosity reading (during ramp down) | | | |
| control | 28.66 | 12.05 | 8.021 |
| 3 min vibration | 25.95 | 10.99 | 7.360 |
| 10 min vibration | 26.47 | 11.19 | 7.498 |

In Table 4, we see the control go from a viscosity of about 64 poise at 100 $sec^{-1}$ shear rate, down to about 14 poise at 900 $sec^{1}$ shear rate, then up to about 71 poise at 100 $sec^{1}$ shear, which is greater than its viscosity at 100 $sec^{1}$ shear rate on the ramp up. Therefore, this mascara has been thickened considerably by the rheology test. The same pattern can be seen for the three and ten minute samples, although for the most part the whole range of viscosity has shifted up, meaning that pre-shearing with a vibrating brush also thickened the mascara. It should be remembered that the pre-sheared samples sat for two to five minutes prior to running the rheology test, which shows that the thickening effect of the vibrating brush persists for more than two to five minutes.

TABLE 4

| | Viscosity (poise) @ 100 1/sec | Viscosity (poise) @ 400 1/sec | Viscosity (poise) @ 900 1/sec |
|---|---|---|---|
| Viscosity reading (during ramp up) | | | |
| control | 64.07 | 24.91 | 14.15 |
| 3 min vibration | 65.20 | 24.97 | 14.04 |
| 10 min vibration | 71.40 | 26.69 | 14.94 |
| Viscosity reading (during ramp down) | | | |
| control | 70.88 | 25.85 | 14.03 |
| 3 min vibration | 69.74 | 25.56 | 13.89 |
| 10 min vibration | 75.82 | 27.61 | 14.84 |

These tables are important because they show that a vibrating brush according to the present invention has a persisting effect on the mascara that is measurable over a wide range of applied shear, meaning that the effect is pronounced and therefore usable. Whether the overall effect of the vibrating applicator is to decrease or increase the viscosity, depends, in part, on the composition of the mascara.

The rheometric tests just described show that a vibrating brush according to the present invention may have a persisting effect on the rheology of a mascara. However, the actual response of any given mascara to a vibrating brush according to the present invention is generally, quite complex due to the fact that a vibrating applicator according to the present invention oscillates, changing speed and direction continuously as it shears the mascara. The response of the mascara depends on the amount of shearing energy transferred to the mascara, which depends in part on the amplitude and frequency of the brush, the brush geometry and the path that the brush takes through the mascara, the duration of vibration, as well as the surface area of the vibrating applicator head in contact with product. It should also be noted that the mascara product continues to be sheared during application to the eyelashes. As the vibrating brush is being drawn between the eyelashes, the portion of mascara that is in contact with both the brush and the eyelash, is subject to shearing forces. The layers of mascara closest to a lash remain motionless while the layers further away are drawn by the vibrating brush. This situation is quite irregular and complex. In contrast, rheological terms like "thixotropy" and "anti-thixotropy" are defined for constant shear rate situations, while "shear thinning" is defined in relation steadily increasing shear occurring in one direction only. Generally, these types of controlled flow conditions are not created by a vibrating applicator of the present invention. However, like a thixotropic response, it is likely that loss of viscosity is due, in part to the molecular structure arranging itself into a network that is less firm than the network of the undisturbed material. Similarly, like an anti-thixotropic response, it is likely that an increase in viscosity is due to the molecular structure arranging itself into a network that is firmer than the network of the undisturbed material. Furthermore, it is expected that the persisting rheological effect would not last indefinitely, due to the new molecular structure of the mascara reversing itself (or relaxing) while the energy of shear is being dissipated as heat. Nevertheless, the foregoing discussion demonstrates the surprising result, that the effect of a vibrating brush according to the present invention may last long enough to allow a user to effectively manipulate a mascara at the time of application, to change the rheology of the mascara, to yield a benefit, in fact, many benefits.

Throughout the specification, "thixotropic mascara" means a mascara whose overall response to a vibrating applicator is to lose viscosity (decrease in structure), the lose of viscosity persisting for a substantial period of time after the vibration has stopped. The substantial period is long enough for a user to fully apply the mascara in a prescribed manner, say, at least about two to five minutes. Furthermore, the lose of viscosity tends to be self-reversible after the substantial period (rebuilding structure). Throughout the specification, "anti-thixotropic mascara" means a mascara whose overall response to a vibrating applicator is to gain viscosity (increased structure), the gain in viscosity persisting for a substantial period of time after the vibration has stopped. The substantial period is long enough for a user to fully apply the mascara in a prescribed manner, say, at least about two to five minutes. Furthermore, the gain in viscosity tends to be partly or wholly self-reversible after the substantial period (loss of structure).

At any given time, the amount of structuring in a mascara composition, depends on the relative amount of solvent in the composition. In general, by controlling the amount of solvent, the amount of structure in the composition can be influenced. Thus, there are at least two mechanisms for controlling structure, a shearing applicator and loss of volatile solvents.

For mascara, "initial viscosity" means the viscosity that an unsheared mascara has in a closed container (no loss of volatile components). Starting in an undisturbed (un-sheared) state, characterized by an initial viscosity, the overall response of a thixotropic mascara to a vibrating applicator is a lose of viscosity. When the applied shear is abruptly removed, the viscosity of a thixotropic mascara will build back up, over time, to a final value that is substantially near its initial value, unless some other mechanism intervenes. Regarding an anti-thixotropic mascara, its overall response to a vibrating applicator is a gain of viscosity. However, an increase in viscosity may not occur right away, as the anti-thixotropic response of any material generally depends on the shear history of a material. Rather, the first response of even an anti-thixotropic mascara (as defined above), may be to lose viscosity. Sometime after this initial response, with additional shearing, a build up of viscosity begins, as a new molecular ordering takes shape. Because the anti-thixotropic behavior may not manifest right away, it may be necessary to instruct a user to pre-vibrate the mascara for a prescribed time before applying to the lashes, but the prescribed time depends on the actual composition. At any rate, after an increase in viscosity and after the applied shear has been removed, the viscosity of an anti-thixotropic mascara will drop, over time, to a final value that is substantially near its initial value, unless some other mechanism intervenes. What is advantageous and wholly unknown prior to this disclosure, is that the observed duration of the persisting rheological effect is long enough to afford an opportunity to interrupt the self-reversing relaxation of the sheared mascara, so that the final viscosity of the mascara may be substantially different from its initial viscosity. In the same manner, it is also possible that other rheological properties may achieve final values that are different from their initial values. In this way, it is possible to provide a customer with a mascara whose rheological properties are similar to known mascaras, with the intent of permanently altering one or more of those properties during application. Or, it is possible to provide a customer with a mascara having unconventional rheological properties, with the intent of altering those properties to have more conventional values after application.

Hereafter, we can also talk about initial and final scores for fullness, separation and clumping. Initial scores are those that would be achieved by a mascara composition that is applied to the lashes without the benefit of a vibrating applicator. Final scores are those that are achieved by a mascara composition that is applied to the lashes with the benefit of a vibrating applicator.

Controlling the Persisting Rheological Effect

After the shear has been removed, the viscosity of a sheared mascara will generally return to near its initial viscosity, unless some other mechanism intervenes. The mechanism of the present invention is the relatively rapid loss of solvents that volatilize off the mascara at ambient conditions. Generally, a loss of volatile solvents from mascara tends to thicken the mascara and increase the mascara's viscosity. Therefore, there is a period of time following the application of the mascara to the lashes, after the applied shear has been removed, wherein the viscosity of the applied mascara is being affected by two phenomena; loss of solvent and structural molecular changes appropriate to sheared thixotropic or anti-thixotropic mascaras. In the case of a thixotropic mascara, the loss of solvent and the structural changes both operate to increase the viscosity of the product. In the case of anti-thixotropic mascara, the loss of solvent works to increase the viscosity of the product while structural changes operate to decrease the viscosity. Because of these competing or complementing effects, the mascara may become fixed at a sheared final viscosity and structure that is different from its unsheared final viscosity structure. "Sheared final viscosity" is the viscosity of the applied mascara after shearing with a vibrating brush and after all solvent loss. "Unsheared final viscosity" is the viscosity that the applied mascara would have if not sheared according to the present invention, but after all solvents have volatilized from the mascara.

For the first time, it has been observed that the loss of solvent can be used to control the sheared final viscosity by adjusting the time for solvent loss compared to the time of the persisting rheological effect caused by shearing with a vibrating brush. "Persisting rheological effect" means that the rheological effect lasts long enough so that the sheared final viscosity depends on the rate of solvent loss. In other words, the rheological effect does not reverse itself so fast, that the choice of solvents becomes immaterial. The time for solvent loss may be adjusted by controlling the ratio of fast to slow volatizing liquids in the composition or the ratio of volatiles to solids in the composition. Generally, the more solvent in the formula, the more time there will be for the persisting rheological effect to reverse, and vice versa. In different situations it will be beneficial for the persisting effect to be of longer or shorter duration.

The principle advantage to this system is the ability to have it both ways, so to speak. For example, a user may be supplied with a mascara system that, because of the reduced viscosity during shearing, flows more easily onto the lashes, providing a smoother, easier application of more product, with good separation and decreased clumping, while on the other hand fullness and overall look do not suffer because sufficient time is allotted for the structure to rebuild to a beneficial level.

In another example, a user is supplied with a mascara which initial viscosity is lower than usual, but which viscosity and structure are increased at the time of application by a vibrating brush. Following application, the structure is not allowed to substantially relax due to a rapid loss of solvent, and fullness is "locked in", so to speak. The benefits of formulating thinner mascaras accrue in manufacturing. As mentioned, because mascaras are so thick and difficult to handle any reduction in viscosity during manufacture saves energy and costs. Other examples will be readily apparent to those skilled in the art.

In developing a combination mascara and vibrating brush system, what is crucial is some idea of the response of the mascara to a vibrating brush. Of course, the developer always has the option of instructing a user when to use vibration and when not to use it. Generally, vibration may used throughout application, while the applicator is in the reservoir and on the lashes, or vibration may be employed only in the reservoir or only on the lashes. The developer is free to choose this based on the response of the mascara to the vibrating brush. Therefore, the present invention also encompasses a kit that comprises instructions for use of a vibrating mascara brush.

One general application of these principles could be stated this way. Say a developer wants to create a mascara composition with decreased lash clumping compared to some pre-final version of the mascara. By "pre-final", we mean a composition that serves as the basis of a new composition. Conventionally, a developer may increase the level of liquids that evaporate relatively slowly, thereby keeping the mascara wetter and more flowable. A disadvantage of doing this is that it tends to decrease fullness and increase smudging of the composition and ease of transfer to another surface, because the product viscosity remains lower for a longer period of time, perhaps well after the application is finished. Alternatively, according to the present invention a developer could keep a lower level of slowly evaporating liquids, while making the formula sufficiently thixotropic so that an appropriately selected vibrating applicator will temporarily reduce viscosity which will reduce clumping during application. After application, when the sheared mascara is on the lashes with no clumping, the viscosity of the mascara builds for two reasons: the molecular restructuring associated with thixotropic fluids and the loss of rapidly evaporating fluids from the composition. Which one contributes more to fullness and thickening depends on the level of solvent loss and on the degree of shearing. Here is another, new advantage for the developer. If the solvents volatilize quickly enough, the molecular restructuring may not be completed before the mascara sets up. Therefore, it may be possible that the sheared final viscosity of the applied mascara will be lower than its unsheared final viscosity, but still within acceptable parameters. On the other hand, if the solvent volatilizes slowly enough, the restructuring may be substantially completed and then further loss of solvent will complete the thickening, so that the sheared final viscosity may be substantially the same as the unsheared final viscosity. This molecular restructuring of the mascara on the lashes thickens the mascara and makes it less susceptible to smudging. Thus, the developer has supplied the customer with a better product as far as ease of application and clumping are concerned, without increasing smudge or transfer.

Another general application of these principles could be stated this way. Say a developer has a pre-final version of a product, but wants to increase the levels of fullness, thickness, and lengthening of the product. Typically, a developer may want to incorporate a high level of solids into the formula, to give added structure and fullness to the mascara. The drawbacks of doing this include increased costs and complexity associated with manufacture and filling. The drawbacks may be sufficient to render mass production of the product unfeasible. This may force a developer to compromise the formula. In contrast, according to the present invention, the developer may keep the level of solids relatively low, while intentionally making the mascara sufficiently anti-thixotropic. "Sufficiently anti-thixotropic" means that an appropriately selected vibrating brush used in the manner described herein, will impart added molecular structure to the mascara. After the application, the solvent system has been designed so that loss of solvent occurs more quickly than loss of the added molecular structure. The relatively rapid loss of solvent prevents the firmer molecular network from completely deteriorating. The result is that the applied mascara sets up with more structure (i.e. is thicker) than if a vibrating applicator had not been used. Thus the developer has achieved a mascara having good fullness, thickness and length, that is practical to mass produce.

Prior to the Kress application, the combination of a mascara and an effective vibrating brush is unknown in the prior art. "Effective vibrating brush" means a brush that is effective to alter the viscosity of a mascara in a predictable way, including having a persisting, measurable effect on the viscosity of the mascara. Identifying the parameters of an effective vibrating brush is a straightforward process. Using standard rheological measurement equipment, as described above, flow charts may be generated for a control sample and for samples that were pre-sheared with a vibrating brush within a known time prior to the flow test. The degree of shifting of the up and down pre-sheared curves away from the control curves is indicative of the degree of effect that the vibrating brush is having on the mascara. The difference in area between the up and down flow curves of pre-sheared samples and the control sample indicates whether the brush is making the mascara more or less thixotropic or more or less anti-thixotropic. If little or no effect is observed, various brush parameters may be altered and the tests repeated until an effective brush is identified.

Armed with this knowledge, a developer may by routine experimentation arrive at a level of volatiles and/or structuring agents and a rate of volatile loss that supports the desired mascara performance, as described above. More generally, having concocted a pre-final mascara composition, the developer will obtain stress verses applied shear flow curves like FIG. 1 or 2. The vibrating brush used to pre-shear the test samples may be chosen by any of several methods. For example, if there is no prior experience or expectation of mascara response, then an arbitrary brush geometry may be used. Alternatively, a manufacturer may want to sell the mascara with a commercially successful brush. Alternatively, based on experience, the developer may already have a good idea of where to start. After obtaining the flow curves, the degree of any rheological effect may be inferred from the shifting of the pre-sheared curves away from the control curves. The minimum time that any rheological effect persists may be inferred from the time between pre-shear and actual measurements. Based on this information, the developer may change the brush parameters and run the flow tests again. Brush parameters include physical dimensions, material properties, vibrational frequency and amplitude. Physical dimensions include shape of the envelope, bristle length and density. Material properties include stiffness, surface treatment, slip characteristics. Generally, a useful range of vibrational frequency is expected to be from about 10 to about 1000 cycles per second. By adjusting any of these, an effective brush is identified through routine experimentation. At some point, when the rheological effect is sufficiently pronounced and of sufficient duration, the developer may settle on specific brush parameters. From there, the vibrating brush may be put to actual use in applying mascara to the lashes. By doing so, opportunities for further improvements in performance may be noted. Finally, the pre-final mascara composition will be reformulated by adjusting the levels and types of volatiles and/or structuring agents in the composition, to support or hinder the amount of molecular restructuring that is allowed to take place. Thus, the rheology plots described herein become an powerful tool during the formulation of mascaras to be used with a vibrating brush.

As noted above, in recent years, gel mascaras or gel-based mascaras have gained popularity. The gel network is able to provide significant structure to the mascara, so that a reduced amount of wax, sometimes no wax, is needed. By "gel-based mascara" we mean a mascara whose rheological structure is provided in whole or in part, by an effect of one or more gelling agents. "Gel-based mascara" includes mascara compositions with as little as 0.01% total gellant. Preferably, however, at least 10% total gellant is used. Gel-based mascaras may or may not contain other structuring agents, such as waxes. If waxes are present, preferably the total amount of waxes is less than 10%. An example of an oil-in-water, gel-based mascara that exhibits improved fullness and separation with relatively little clumping is shown in table 5, column 1.

TABLE 5

| a gel-based mascara | | | | |
|---|---|---|---|---|
| ingredient | 1 | 2 | 3 | 4 |
| deionized water | q.s. | q.s. | q.s. | q.s. |
| hydroxyethylcellulose | 0.7000 | — | 0.7000 | 0.7000 |
| pantethine | 0.030 | 0.030 | 0.030 | 0.030 |
| panthenol | 0.030 | 0.030 | 0.030 | 0.030 |
| iron oxides | 9.000 | 9.000 | 9.000 | 9.000 |
| aminomethyl propanediol | 1.600 | 1.600 | 1.600 | 1.600 |
| simethicone | 0.100 | 0.100 | 0.100 | 0.100 |
| sodium polyacrylate | 0.100 | 0.100 | — | 0.200 |
| silica | 2.000 | 2.000 | 2.000 | 2.000 |
| kaolin | 1.000 | 1.000 | 1.000 | 1.000 |
| mica | 2.750 | 2.750 | 2.750 | 2.750 |
| PTFE | 0.500 | 0.500 | 0.500 | 0.500 |
| isostearic acid | 1.200 | 1.200 | 1.200 | 1.200 |
| hydrogenated olive oil/ olive oil unsaponifiables | 2.000 | 2.000 | 2.000 | 2.000 |
| paraffin | 3.000 | 3.000 | 3.000 | 3.000 |
| polyisobutene | 3.500 | 3.500 | 3.500 | 3.500 |
| stearic acid | 5.500 | 5.500 | 5.500 | 5.500 |
| carnauba wax | 5.350 | 5.350 | 5.350 | 5.350 |

TABLE 5-continued

| a gel-based mascara | | | | |
|---|---|---|---|---|
| ingredient | 1 | 2 | 3 | 4 |
| glyceryl stearate | 3.000 | 3.000 | 3.000 | 3.000 |
| VP/eicosene copolymer | 0.500 | 0.500 | 0.500 | 0.500 |
| cholesterol | 0.100 | 0.100 | 0.100 | 0.100 |
| polyvinyl acetate | 7.000 | 7.000 | 7.000 | 7.000 |
| caprylyl glycol/ phenoxyethanol/ hexylene glycol | 1.000 | 1.000 | 1.000 | 1.000 |
| phenoxyethanol | 0.612 | 0.612 | 0.612 | 0.612 |

A gel network is so efficient at creating structure, that gel-based mascaras and wax-based mascara typically have comparable order of magnitude viscosities. Thus, gelling agents are able to provide structure that enhances fullness. However, the response of a gel-based mascara to a vibrating applicator has been observed to differ from the response of a non-gel, wax-based mascara. This difference can be exploited.

Figure 3:
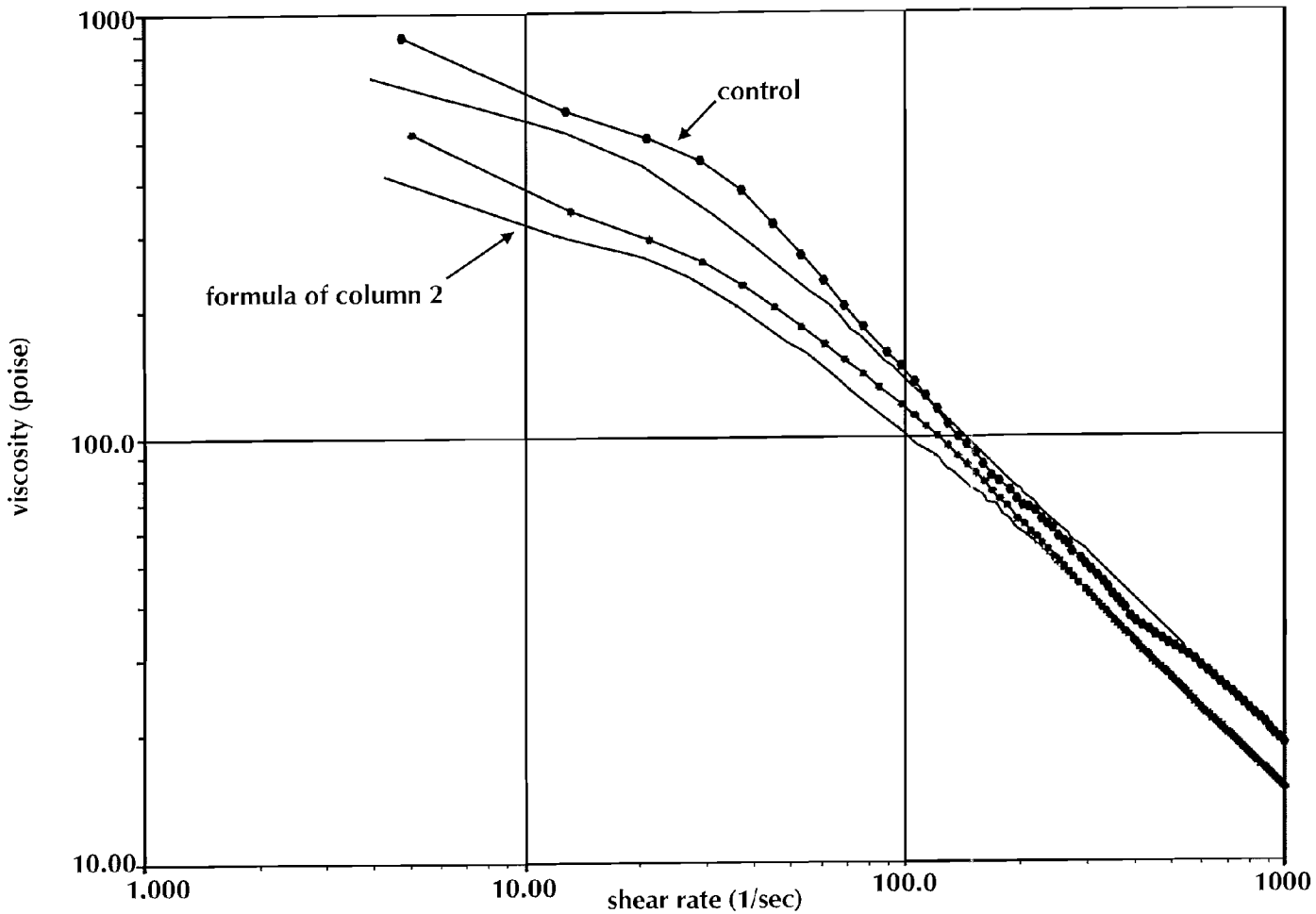
FIG. 3 is a viscosity verses applied shear curve, for compositions with varying amounts of hydroxyethylcellulose.
Figure 4:
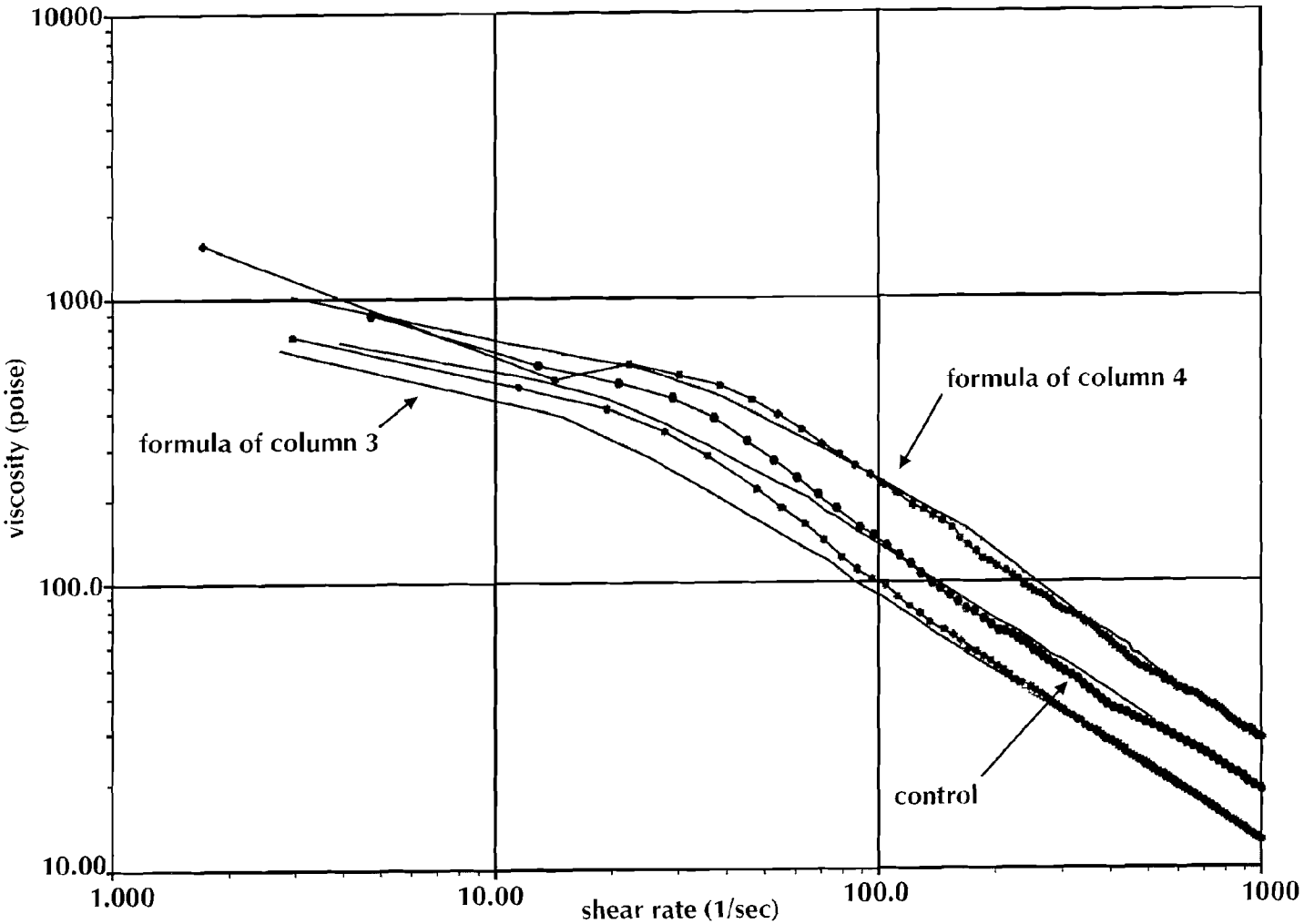
FIG. 4 is a viscosity verses applied shear curve, for compositions with varying amounts of sodium polyacrylate.

To demonstrate the difference, compositions according to table 5 were prepared. Column 1 represents a control formula. The difference between columns 1 and 2 is the level of hydroxyethylcellulose: 0.7% in the control, and 0% in column 1. The difference between column 1 and columns 3 and 4 is the level of sodium polyacrylate: 0.1% in the control, 0% in column 3, and 0.2% in column 4. For each composition, the viscosity was measured over a range of shear, as described above. The data are shown in FIG. 3 (a viscosity verses applied shear curve, for compositions with varying amounts of hydroxyethylcellulose), FIG. 4 (a viscosity verses applied shear curve, for compositions with varying amounts of sodium polyacrylate). In FIGS. 3 and 4, the curves are labeled with reference to table 5. Some results are shown in table 6.

TABLE 6

| | 1 (control) (0.7% hydroxy ethyl-cellulose, 0.1% sodium poly-acrylate) | 2 (0% hydroxy ethyl-cellulose, 0.1% sodium poly-acrylate) | 3 (0.7% hydroxy ethyl-cellulose, 0% sodium poly-acrylate) | 4 (0.7% hydroxy ethyl-cellulose, 0.2% sodium poly-acrylate) |
|---|---|---|---|---|
| initial viscosity (cps) | 900 | 525 | 750 | 1600 |
| sheared down viscosity (1000 $sec^{-1}$) | 18 | 15 | 15 | 28 |

The interesting thing to note in this data, is the change in the difference in viscosity between the formulae, initially and after being sheared. Initially, the four formulae differ in viscosity by hundreds of cps. After shearing down, the difference in viscosity of the formulae is much smaller. We interpret this by saying that before shear, additional gellant leads to additional structure. However, after shearing all the additional structure due to the additional gellant is lost. This behavior of gellant in the mascara is different from the behavior f wax in the mascara, where a significant amount of structure due to wax is retained in the mascara after shearing down.

This is a useful result. It says that when using a vibrating applicator, the formulator may increase fullness without decreasing separation and without making clumping worse. Fullness is increased because the amount of structure is increased by the additional gellant. However, upon shearing, that structure is temporarily lost so that application is easier, separation is better and clumping is reduced. After shearing, additional structure rebuilds. The same benefit, to a similar degree is not obtained in a non-gel, wax-based mascara. Thus, when increased fullness, improved separation and decreased clumping are the goal, gel based mascaras are preferred. One or more gellants from those listed above will be useful, as well as other gellants. Based on a knowledge of gellant materials, it is expected that the most benefit will be achieved with the use of one or more polyamide materials or derivatives thereof, such as those mentioned or disclosed in U.S. Pat. No. 6,716,420; U.S. Pat. No. 6,869,594; and U.S. Pat. No. 7,078,026.

As noted above, microspheres or spheroidal particles, are sometimes added to mascara to reduce viscosity and aid spreading a mascara evenly over the lashes. With a vibrating brush, a problem of the spheroids sliding over and not adhering to the lashes has been observed. This problem is not observed with a non-vibrating brush. Applicants have unexpectedly discovered that the problem is eliminated or reduced when spheroidal particles are used in conjunction with one or more platy materials. For example, the mascara composition shown in table 5, column 1, comprises 2.00% spherical silica and 2.75% mica (a platy material). The mascara with this combination performed noticeably better than the same composition with 4.75% spherical silica and no mica and also noticeably better than the same composition with 4.75% mica and no silica. The combination of the spherical particle and platy material eliminates the lack of adhesion to the lashes, and does so without significantly increasing the tackiness of the composition. Thus, the combination of a spherical particle and a platelet particle is particularly advantageous when a vibrating mascara brush is going to be used.

Furthermore, it is believed that a Kress vibrating applicator in combination with certain compositions (mascara or other) will lead to a new, unexpected phenomenon, which is the build up a useful amount of static charge on the surfaces of certain particles in the composition. The static charge build up may be a result of the friction between the particles and the vibrating applicator, or may be a result of friction between different particles in the composition, the friction being a result of the vibrating applicator. Once the particles acquire a charge, they maintain the charge, because the continuous medium of the mascara composition is sufficiently non-conductive. Charged mascara, for example, is useful for better adhesion to the lashes, leading to a fuller, thicker application. The static charge build up is only created in the mascara at the time of application, and does not need to be provided during manufacture. The combination of a mascara composition and vibrating applicator that is capable of inducing a static charge build up on one or more particles in the composition, is new and not anticipated or suggested by anything in the prior art. Which particles are better at receiving and holding a charge, in which types of compositions, may be determined by routine experimentation.

What is claimed is:

1. A combination mascara composition and vibrating mascara applicator, wherein the mascara composition is a gel-based mascara, and the vibrational frequency of the applicator is from 10 to 1000 cycles per second.

2. The combination of claim 1, wherein the mascara composition is a non-emulsion gel-based mascara.

3. The combination of claim 1, wherein the mascara composition is an emulsion gel-based mascara.

4. The combination of claim 3 wherein the composition comprises one or more gelling agents in a water phase.

5. The combination of claim 3 wherein the composition comprises one or more gelling agents in an oil phase.

6. The combination of claim 5 wherein the composition comprises one or more polyamide gelling agents or derivatives thereof.

7. The combination of claim 1 wherein the gel-based mascara composition comprises less than 10% waxes.

8. The combination of claim 1 wherein the gel-based mascara composition comprises at least 10% total gellant.

9. A combination mascara composition and vibrating mascara applicator, wherein the mascara composition comprises spherical and platy particles, and the vibrational frequency of the applicator is from 10 to 1000 cycles per second.

10. The combination of claim 9 wherein the composition comprises spherical silica and mica platelets.

11. A combination mascara composition and vibrating mascara applicator, wherein the vibrational frequency of the applicator is from 10 to 1000 cycles per second, and the vibrating applicator is capable of inducing a static charge build up on one or more particles in the composition.

* * * * *